US010981719B2

(12) United States Patent
Ford et al.

(10) Patent No.: US 10,981,719 B2
(45) Date of Patent: Apr. 20, 2021

(54) MOBILE COLLAPSIBLE STORAGE SILO

(71) Applicant: WESTCAP AG CORP., Grande Prairie (CA)

(72) Inventors: Darrell Ford, Spruce Grove (CA); Lonny Thiessen, Hythe (CA)

(73) Assignee: WESTCAP AG CORP., Grande Prairie (CA)

( * ) Notice: Subject to any disclaimer, the term of this patent is extended or adjusted under 35 U.S.C. 154(b) by 50 days.

(21) Appl. No.: 16/341,749

(22) PCT Filed: Nov. 2, 2017

(86) PCT No.: PCT/CA2017/051304

§ 371 (c)(1),
(2) Date: Apr. 12, 2019

(87) PCT Pub. No.: WO2018/081901

PCT Pub. Date: May 11, 2018

(65) Prior Publication Data

US 2020/0047991 A1 Feb. 13, 2020

Related U.S. Application Data

(60) Provisional application No. 62/417,160, filed on Nov. 3, 2016.

(51) Int. Cl.
*B65D 88/52* (2006.01)
*B65D 88/26* (2006.01)
(Continued)

(52) U.S. Cl.
CPC ..... *B65D 88/52* (2013.01); *B65D 88/26* (2013.01); *B65D 88/544* (2013.01);
(Continued)

(58) Field of Classification Search
CPC ..... B65D 88/26; B65D 88/30; B65D 88/32; B65D 88/52; B65D 88/544; B65D 90/024;
(Continued)

(56) References Cited

U.S. PATENT DOCUMENTS 2,036,363 A * 4/1936 Schaefer ..... B65D 90/024 52/245
2,722,171 A * 11/1955 Deringer ..... B65D 90/046 99/646 R
(Continued)

FOREIGN PATENT DOCUMENTS

| | | |
|---|---|---|
| CN | 101832049 | 9/2010 |
| EP | 0592276 | 4/1994 |
| GB | 1409888 | 10/1975 |

*Primary Examiner* — James M Ference
(74) *Attorney, Agent, or Firm* — Ryan W. Dupuis; Kyle R. Satterthwaite; Ade + Company, Inc.

(57) ABSTRACT

A collapsible storage silo having an expanded configuration includes: (a) a shell for circumscribing storage space and comprising a plurality of concentrically nested tubular members that are collapsible; (b) a lift system operable to slidably expand the plurality of concentrically nested tubular members to place the silo in its expanded configuration; and (c) a mast operable to support the lift system. The mast is pivotable between horizontal and vertical positions relative to a frame. A winch attaches to the mast and a cable extends between the winch and an outermost tubular member to expand the silo such that inwardly and outwardly projecting lips of nested members engage each other and a conical hopper engages an innermost tubular member. A flexible inner liner attaches between an outermost tubular member and the hopper. A collapsible roof has a flexible roof membrane and a plurality of radially extending foldable rib members.

18 Claims, 17 Drawing Sheets

(51) Int. Cl.

| | |
|---|---|
| ***B65D 88/54*** | (2006.01) |
| ***B65D 90/02*** | (2019.01) |
| ***B65D 90/04*** | (2006.01) |
| ***B65D 90/08*** | (2006.01) |
| ***E04H 7/22*** | (2006.01) |

(52) U.S. Cl.
CPC ..... *B65D 90/024* (2013.01); *B65D 90/046* (2013.01); *B65D 90/08* (2013.01); *E04H 7/22* (2013.01); *B65D 2588/54* (2013.01); *B65D 2590/043* (2013.01)

(58) Field of Classification Search
CPC ..... B65D 90/046; B65D 90/08; B65D 90/14; B65D 90/16; B65D 2588/54; B65D 2590/043; B66F 11/00; E04H 7/22
See application file for complete search history.

(56) References Cited

U.S. PATENT DOCUMENTS 2,808,164 A * 10/1957 Glendinning ..... B65D 88/30 414/332
3,024,930 A * 3/1962 Sims ..... B28C 7/049 414/332
3,208,616 A * 9/1965 Haskins ..... B65D 88/30 414/332
3,315,929 A * 4/1967 Keiser ..... B65D 90/16 137/899.3
3,407,836 A * 10/1968 Keiser ..... B65D 90/16 137/899.3
3,586,181 A * 6/1971 Brock ..... B65D 88/30 414/332
3,664,072 A * 5/1972 Lieckfeld ..... B65D 88/26 52/63
3,712,002 A * 1/1973 Hillinger ..... B65D 88/26 52/63
3,792,790 A * 2/1974 Brubaker ..... B65D 88/30 414/332
3,934,739 A * 1/1976 Zumsteg ..... B60P 1/64 414/332
3,985,254 A * 10/1976 Grandury ..... B60P 1/64 414/498
4,112,634 A * 9/1978 Bissinger ..... B65D 88/005 52/67
4,164,244 A * 8/1979 Meier ..... B65B 1/40 141/156
4,187,047 A * 2/1980 Squifflet, Sr. ..... B60P 1/64 414/332
4,337,014 A * 6/1982 Farnham ..... E04H 7/30 414/332
4,338,752 A * 7/1982 Stanelle ..... B65D 88/005 52/194
4,348,146 A * 9/1982 Brock ..... B65D 88/30 414/332
4,482,281 A * 11/1984 Musil ..... B65D 88/30 414/332
4,621,972 A * 11/1986 Grotte ..... B60P 1/64 280/414.5
4,625,478 A * 12/1986 Goode ..... B65D 88/08 52/192
4,721,425 A * 1/1988 Strocker ..... B65G 65/32 414/298
4,775,275 A * 10/1988 Perry ..... B28C 7/0495 366/18
5,339,996 A * 8/1994 Dubbert ..... B28C 7/0046 182/186.6
8,434,278 B1 * 5/2013 Dueck ..... E04H 7/22 52/194
8,746,478 B2 * 6/2014 Claeys ..... B65D 90/205 220/9.3
9,957,104 B2 * 5/2018 Hindbo ..... B65D 88/16
10,752,433 B2 * 8/2020 Thiessen ..... B65D 88/30
2003/0035340 A1 * 2/2003 Rowe ..... B01F 13/0035 366/156.1
2010/0196130 A1 * 8/2010 Lavoie ..... B60P 1/00 414/469
2012/0024738 A1 * 2/2012 Herman ..... B60P 1/486 206/459.1
2013/0142601 A1 * 6/2013 McIver ..... B65D 88/30 414/288
2014/0041322 A1 * 2/2014 Pham ..... B65G 65/32 52/194
2014/0093339 A1 * 4/2014 Friesen ..... B65D 88/30 414/288
2015/0008218 A1 * 1/2015 Lupul ..... B65D 88/10 220/8
2015/0044003 A1 * 2/2015 Pham ..... B65D 90/12 414/332
2015/0044004 A1 * 2/2015 Pham ..... B65G 67/24 414/332
2015/0166135 A1 * 6/2015 Pham ..... B65G 69/006 414/812
2015/0166260 A1 * 6/2015 Pham ..... B65D 90/12 414/471
2016/0167559 A1 * 6/2016 Pham ..... B60P 1/6418 414/498
2016/0236880 A1 * 8/2016 Herman ..... B65D 88/30
2016/0251152 A1 * 9/2016 Krupa ..... B65D 88/32 206/386
2016/0362035 A1 * 12/2016 Cain ..... B65G 67/04
2017/0291780 A1 * 10/2017 Sherwood ..... B65G 11/146
2017/0327309 A1 * 11/2017 Hunter ..... B65D 88/30
2018/0044927 A1 * 2/2018 Warnock ..... E04G 1/22
2018/0295782 A1 * 10/2018 Dawoud ..... A01F 25/14
2019/0185258 A1 * 6/2019 Thiessen ..... B65D 88/52
2020/0047991 A1 * 2/2020 Ford ..... B65D 90/024

* cited by examiner

MOBILE COLLAPSIBLE STORAGE SILO

FIELD OF THE INVENTION

The present invention pertains in general to material handling systems and methods, and in particular to a mobile collapsible storage silo system for storing and delivering granular material.

BACKGROUND

Granular material, such as sand, proppant, grain, and the like, is used in bulk quantity in several applications. For example, in hydraulic fracture drilling by oil and gas industries, fracturing fluid comprising a granular proppant material, such as sand and/or ceramics, is pumped into a drill well to create and prop open fractures in rock. Often, activities requiring large amounts of granular material are performed in a remote location, requiring granular material to be shipped to the site and stored in large quantities in a manner that makes the material reliably available in sufficient quantities as required for the particular application. Therefore, there is a need for mobile collapsible storage systems for storing and delivering large quantities of granular material at remote site operations, or other applications requiring temporary granular material storage.

SUMMARY OF THE INVENTION

In some aspects, the present invention provides mobile collapsible storage systems for storing and delivering large quantities of granular material at remote site operations comprising a collapsible silo shell comprised of a plurality of concentrically nested tubular members that are raised and supported in an expanded storage configuration by a central mast that is pivotable between a horizontal position and a vertical raised position. The central mast is tubular and includes within it a rotatable auger for moving granular material up the interior and out the top of the mast for loading the expanded silo shell. The expanded silo shell may be collapsed by allowing or moving the concentric tubular members to slide within each other so that each tubular member rests within its adjacent tubular member. Other structures and material handling systems may the provided.

In accordance with another aspect of the invention, there is provided a collapsible storage silo having an expanded configuration. The silo includes: (a) a shell for circumscribing storage space of the silo, the shell comprising a plurality of concentrically nested tubular members that are collapsible; (b) a lift system operable to slidably expand the plurality of concentrically nested tubular members to place the silo in its expanded configuration; and (c) a mast operable to support the lift system.

The silo may include a frame, the mast being attached to the frame and pivotable between horizontal and vertical positions relative to the frame. The frame may include a plurality of retractable outriggers. The mast may be centrally disposed within the plurality of concentrically nested tubular members when the silo is in its expanded configuration. Each of the concentrically nested tubular members may include at least one of a lower lip and an upper lip, the lower and upper lips of adjacent tubular members engaging each other when the silo is in its expanded configuration. The lower lip may be inwardly projecting and the upper lip may be outwardly projecting. The lift system may include a winch attached to the mast and a cable extending between the winch and the plurality of concentrically nested tubular members. The plurality of concentrically nested tubular members may include an outermost tubular member. The cable may extend between the winch and the outermost tubular member. Each of the concentrically nested tubular members may include at least one of an inwardly projecting lower lip and an outwardly projecting upper lip, the lower and upper lips of adjacent tubular members engaging each other when the silo is in its expanded configuration, the plurality of concentrically nested tubular members may include an outermost the tubular member, and the lift system may include a winch attached to the mast and a cable extending between the winch and the outermost tubular member. The silo may further include a flexible inner liner attached to the outermost tubular member. The plurality of concentrically nested tubular members may include an innermost the tubular member. The silo may further include a conical hopper dimensioned for engaging the innermost tubular member when the silo is in its expanded configuration. The flexible inner liner may be attached between the outermost tubular member and the conical hopper. The silo may include a collapsible roof attached to the mast. The collapsible roof may include a flexible roof membrane and a plurality of radially extending foldable rib members for supporting the flexible roof membrane. The mast may be tubular. The mast may include an auger disposed within the tubular mast. The auger may be operable to move granular material along and within the tubular mast. The silo may include a control unit. The control unit may include a control. The control may be selected from the group consisting of an electrical control and a hydraulic control.

In accordance with another aspect of the invention, there is provided a method of deploying a collapsible storage silo from a collapsed configuration to an expanded configuration. The method involves: (a) deploying a collapsible roof of the silo; (b) pivoting a mast of the silo to a vertical position relative to a frame of the silo; and (c) when the mast is in its vertical position, operating a lift system attached to the mast to slidably expand a plurality of concentrically nested tubular members of the silo, thereby placing the silo in its expanded configuration.

Operating a lift system attached to the mast to slidably expand a plurality of concentrically nested tubular members of the silo, thereby placing the silo in its expanded configuration, may involve: operating the lift system comprising a winch attached to the mast and comprising a cable extending between the winch and the plurality of concentrically nested tubular members until lower and upper lips of adjacent the tubular members engage each other and an innermost the tubular member at its lower lip engages a hopper attached to the frame. Deploying a collapsible roof of the silo may involve: (a) extending foldable rib members of the roof to extend an overlying roof membrane; and (b) locking the roof in its deployed configuration. The method may involve deploying a plurality of outriggers attached to the frame prior to pivoting the mast.

In accordance with another aspect of the invention, there is provided a collapsible storage silo having an expanded configuration. The silo may include: (a) shell means for circumscribing storage space of the silo, the shell means comprising a plurality of concentrically nested tubular members that are collapsible; (b) lift means for slidably expanding the plurality of concentrically nested tubular members to place the silo in its expanded configuration; and (c) mast means for supporting the lift means.

BRIEF DESCRIPTION OF THE FIGURES

These and other features of the invention will become more apparent in the following detailed description in which reference is made to the appended drawings.

DESCRIPTION OF THE PREFERRED EMBODIMENTS

Figure 1:
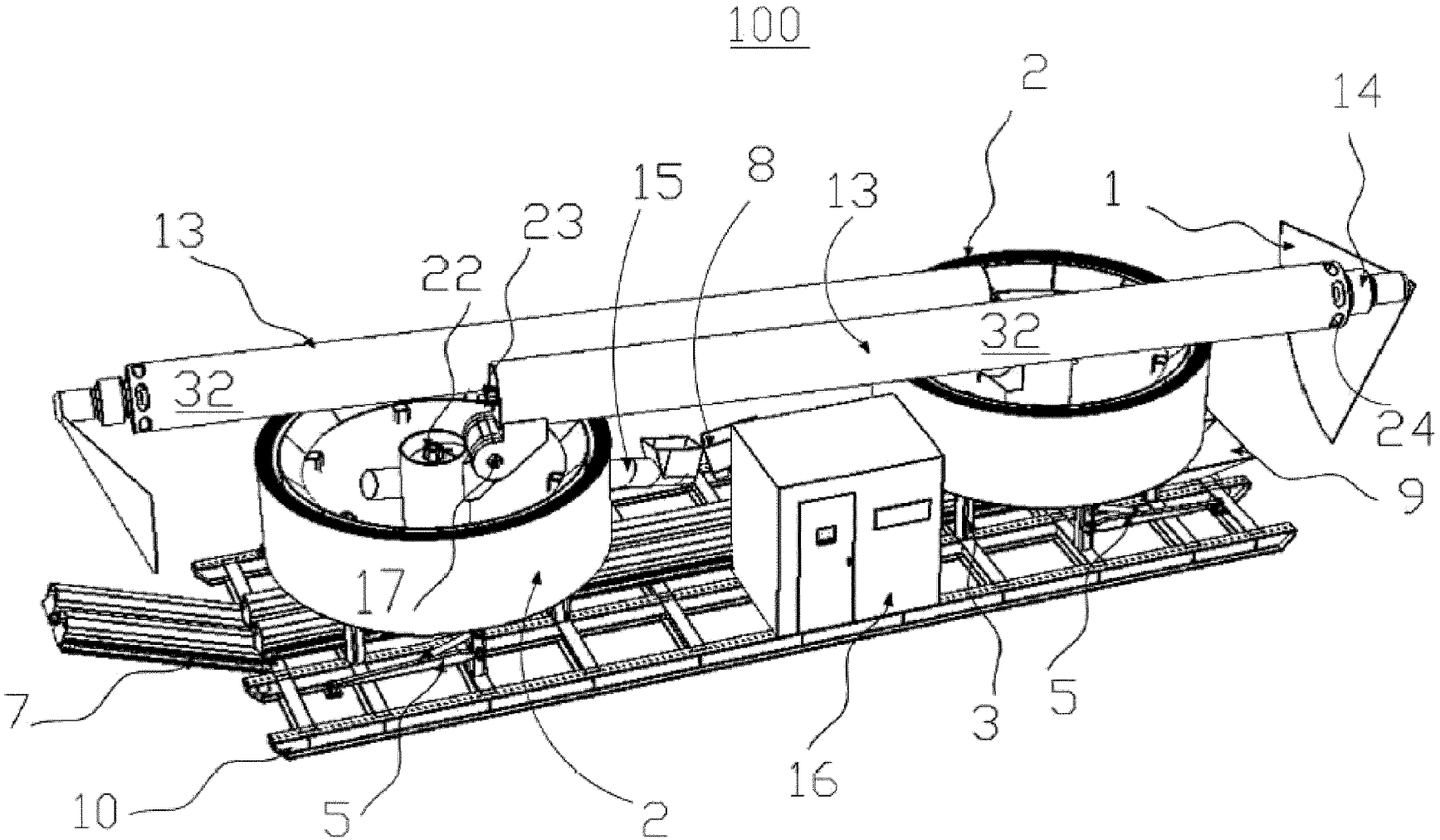
FIG. 1 is a perspective view of a mobile collapsible storage silo in accordance with an embodiment of the present invention shown in a collapsed configuration for transportation.
Figure 2:
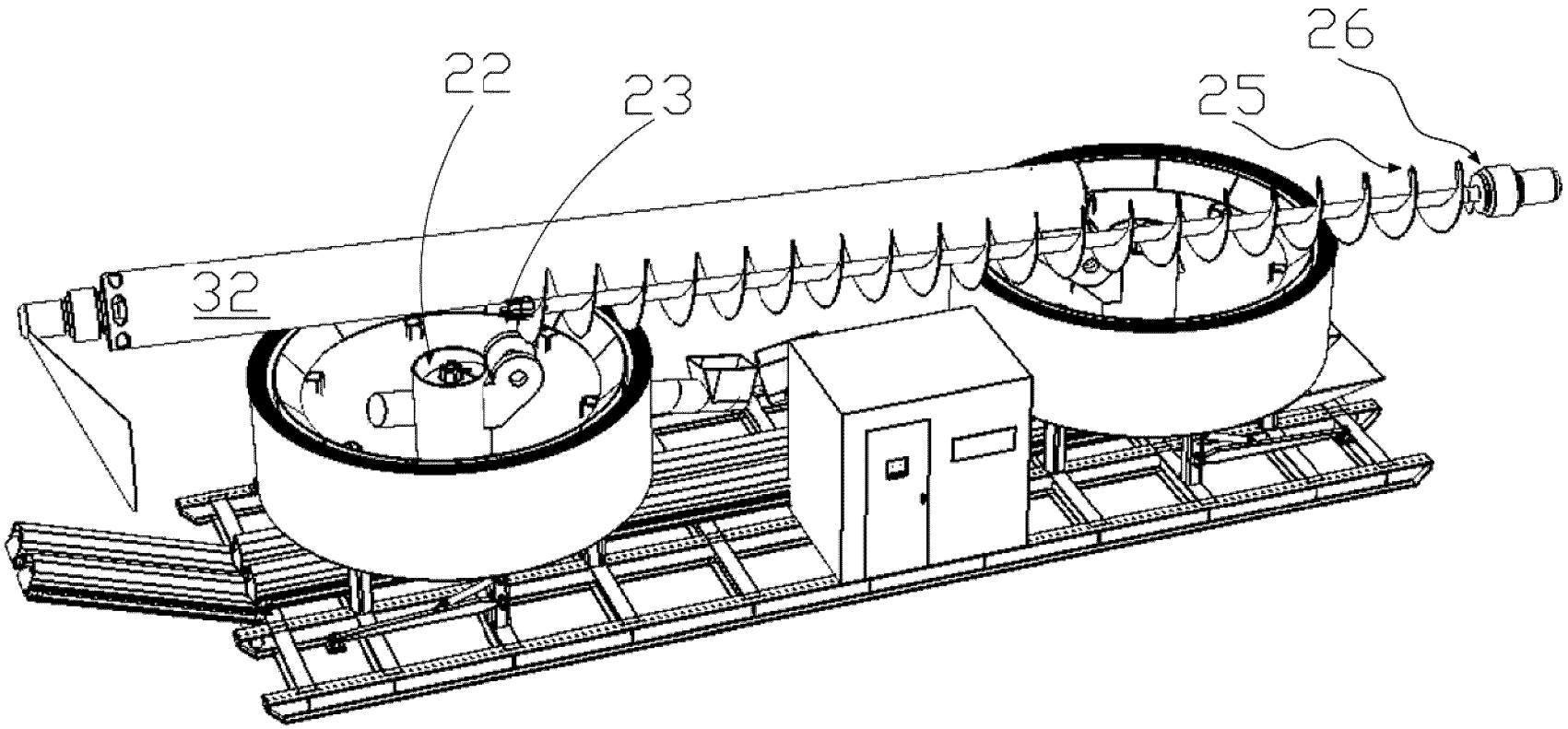
FIG. 2 is a perspective view of the mobile collapsible storage silo of FIG. 1 shown in a transport configuration with one of the vertical screw systems exposed.

Referring to FIGS. 1-15, there is shown a mobile collapsible storage silo 100 in accordance with an embodiment of the present invention. Mobile collapsible storage silo 100 comprises a frame assembly 10 on which is mounted at least one collapsible outer silo shell assembly 2 comprising a plurality of concentrically nested tubular shell members 30, wherein each tubular member 30 is received within its adjacent tubular member to enable the silo shell assembly 2 to collapse into itself as shown in FIGS. 1, 2, 4, 6-7 and 9 whereby each tubular member is nested within its adjacent tubular member.

Figure 9:
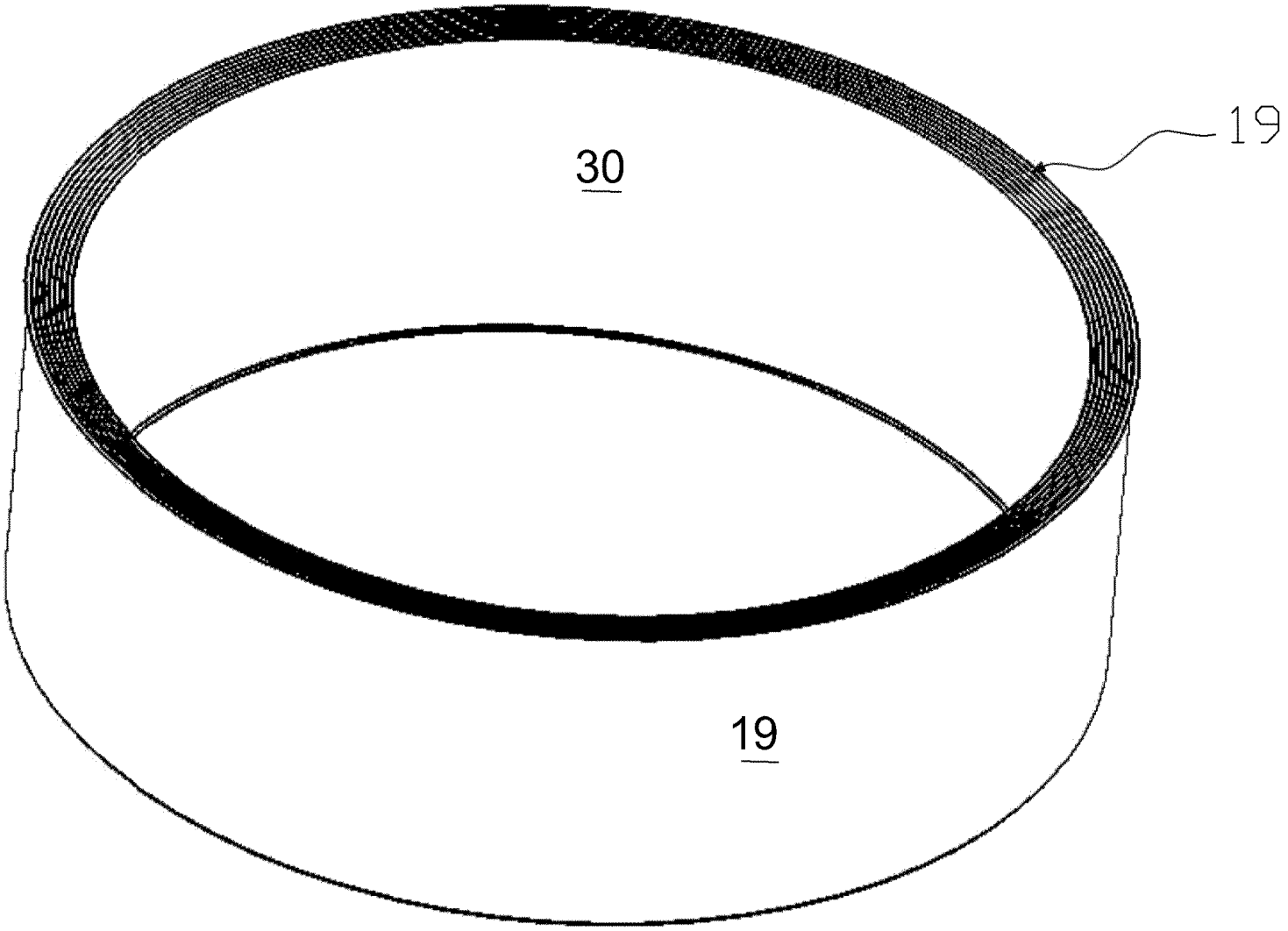
FIG. 9 is a close-up perspective view of the coaxially nested outer shell sections of the mobile collapsible storage silo FIG. 1 shown in isolation in a collapsed configuration.
Figure 9A:
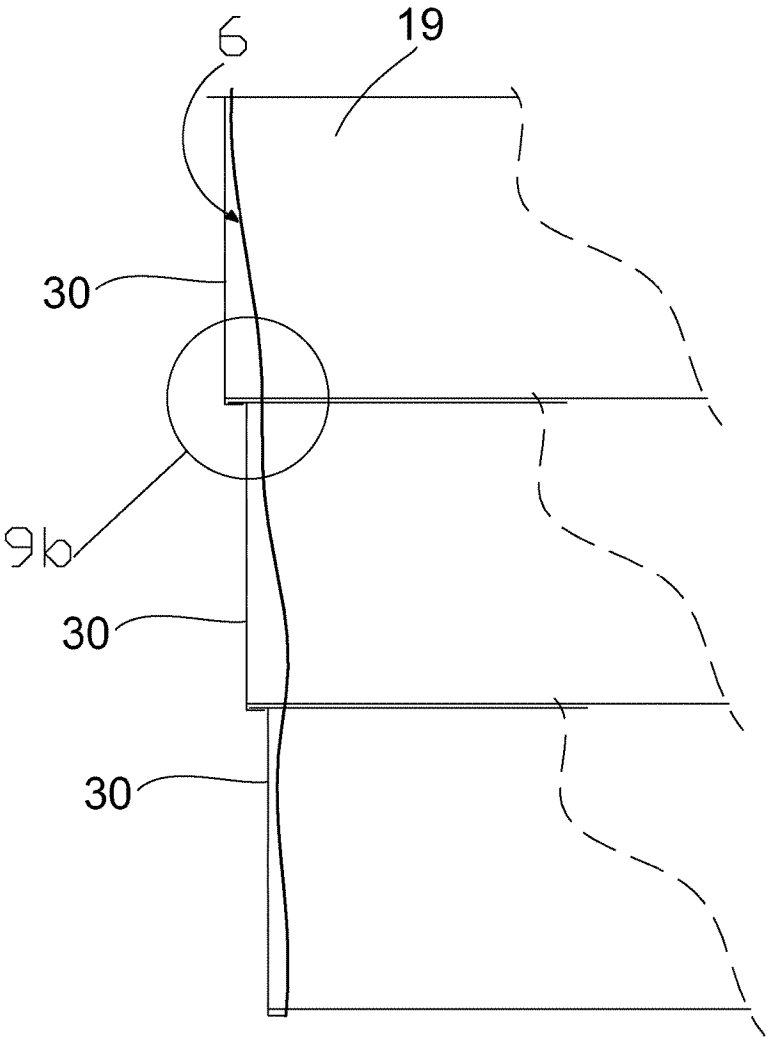
FIG. 9*a* is a close-up longitudinal section of the coaxially nested outer shell sections of the mobile collapsible storage silo FIG. 1 shown in isolation in an extended configuration and showing a detailed view of the connecting feature of the nesting shell sections.
Figure 9B:
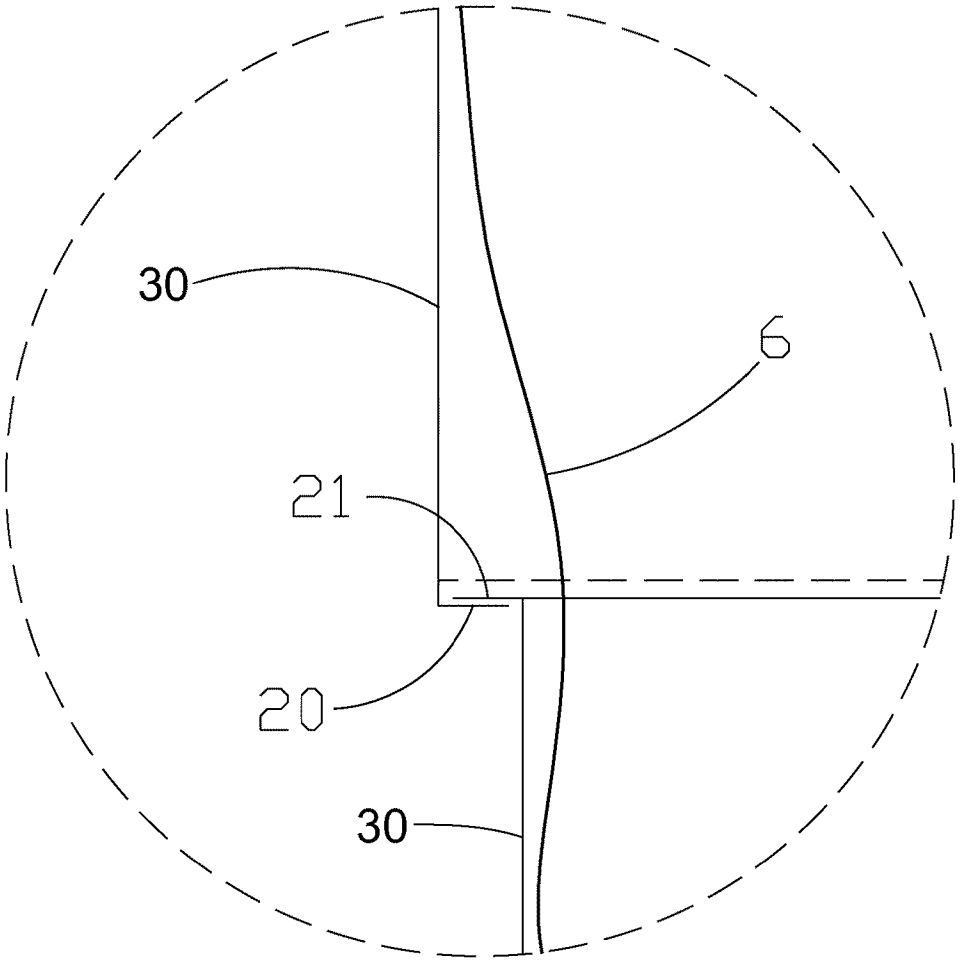
FIG. 9*b* is a close-up of the connecting features of the nesting shell sections shown in FIG. 9*a;*
Figure 10:
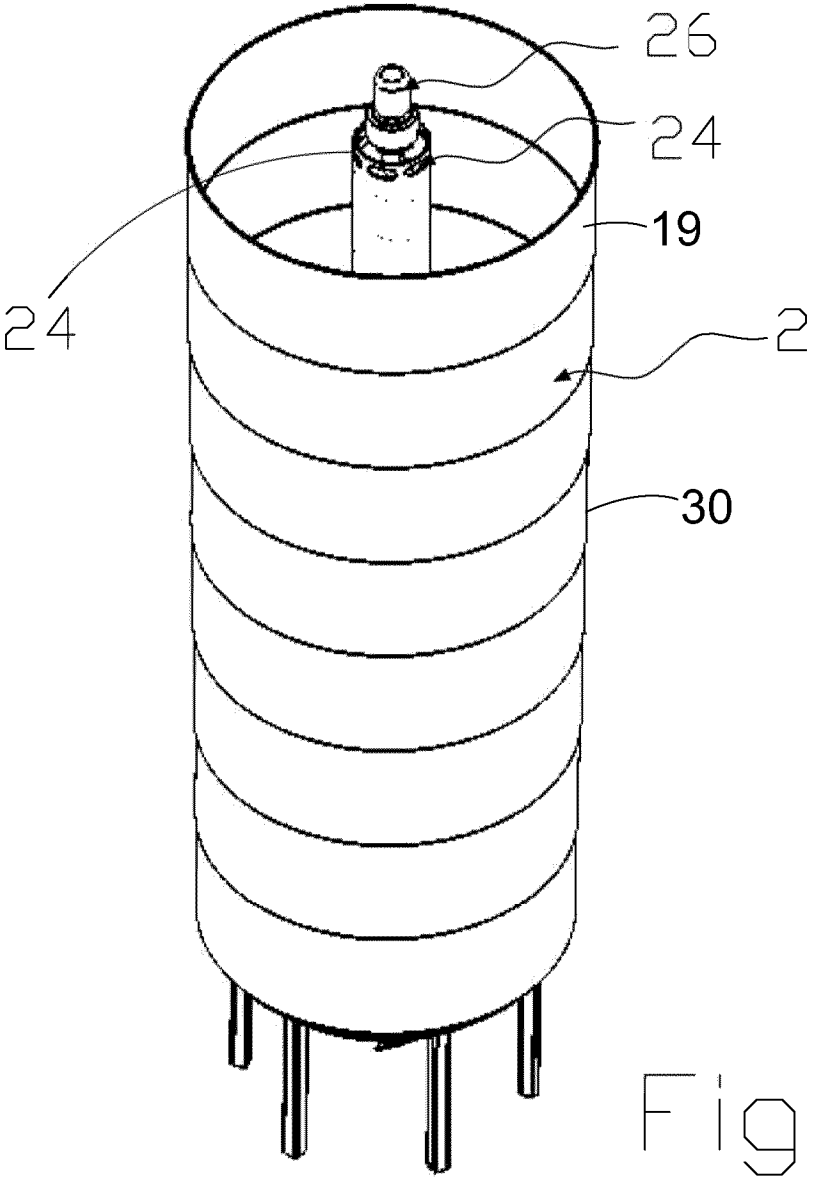
FIG. 10 is a perspective view of the nesting shell sections in a raised configuration of the mobile collapsible storage silo of FIG. 1 with the roof portion removed.
Figure 11:
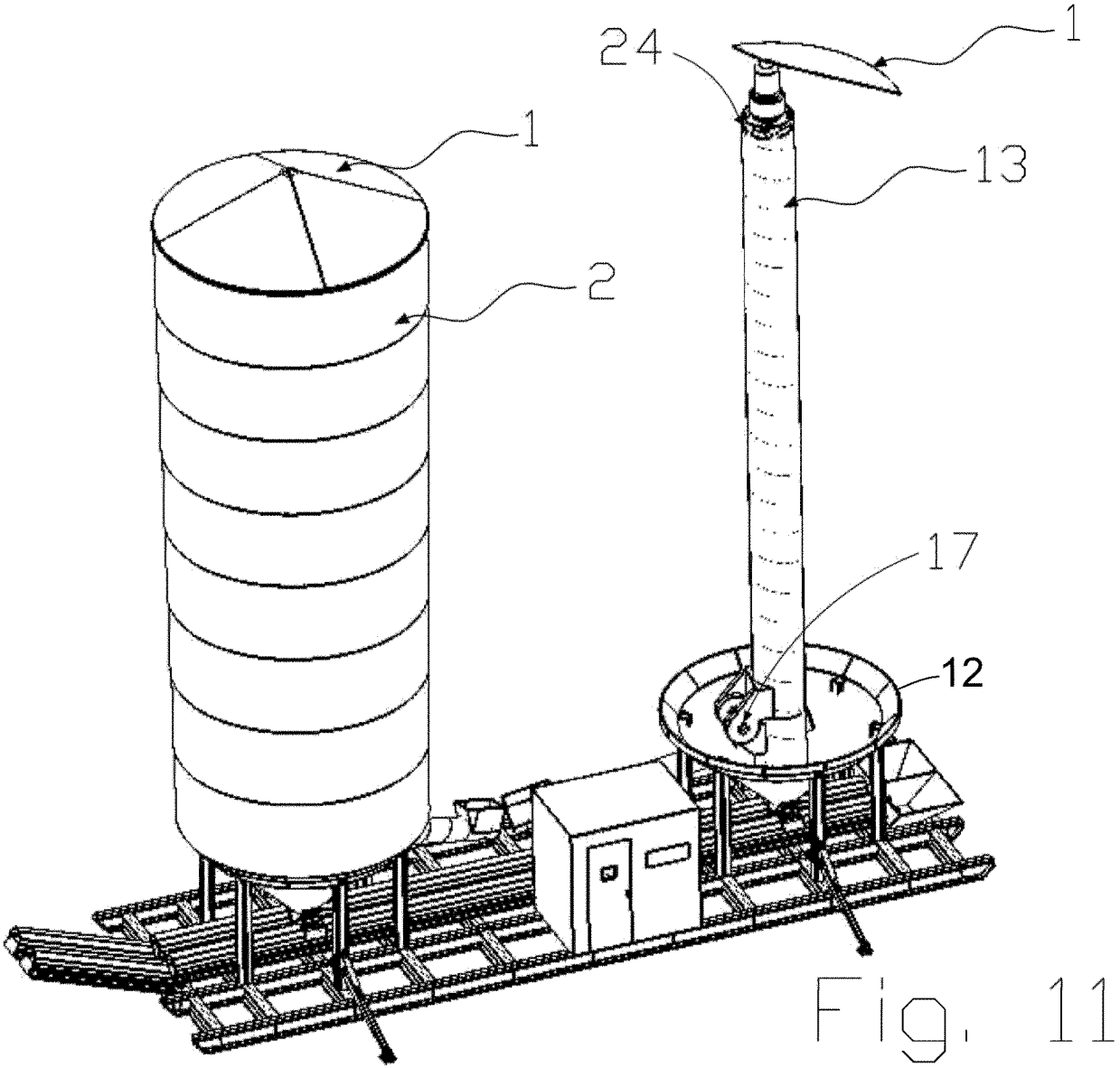
FIG. 11 is a perspective view of the mobile collapsible storage silo of FIG. 1 in which both silo structures are in the deployed configuration but the silo structure on the right is shown with the collapsible nested shell members removed to expose the mast structure.
Figure 12:
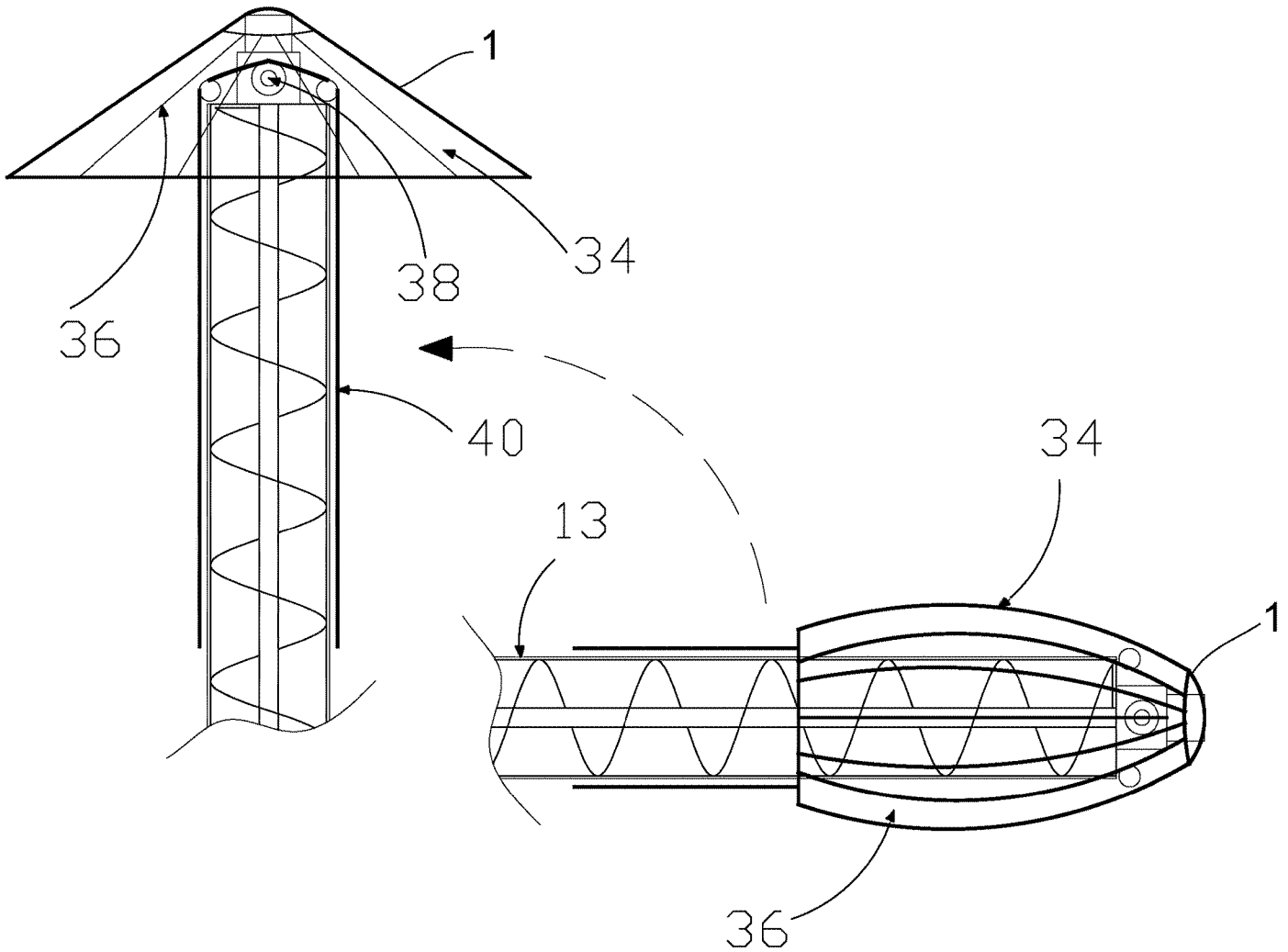
FIG. 12 is a side view of the mast and collapsible roof structure of the mobile collapsible storage silo FIG. 1 shown in isolation both in a deployed configuration and a collapsed transport configuration.
Figure 13:
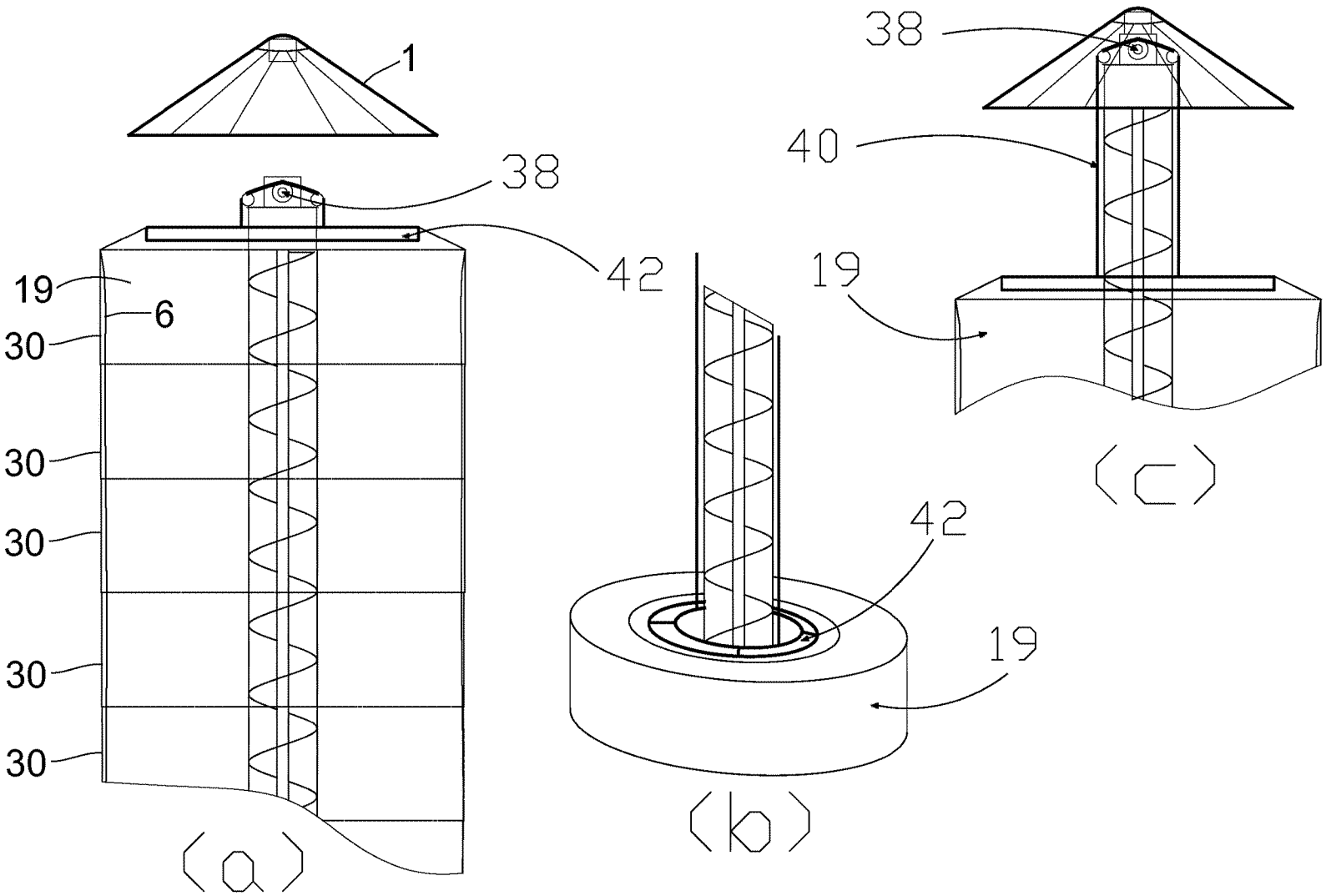
FIG. 13 illustrates the mast lifting system of the mobile collapsible storage silo of FIG. 1 in three views in which (a) is a longitudinal section of a silo structure showing the tubular members, the mast, the roof structure and the lifting winch system, (b) is a perspective close-up view of the topmost tubular member, the lifting frame and the lift tables, and (c) as a close-up section view showing the topmost tubular member, the lifting frame, lift cables and the winch system.
Figure 14:
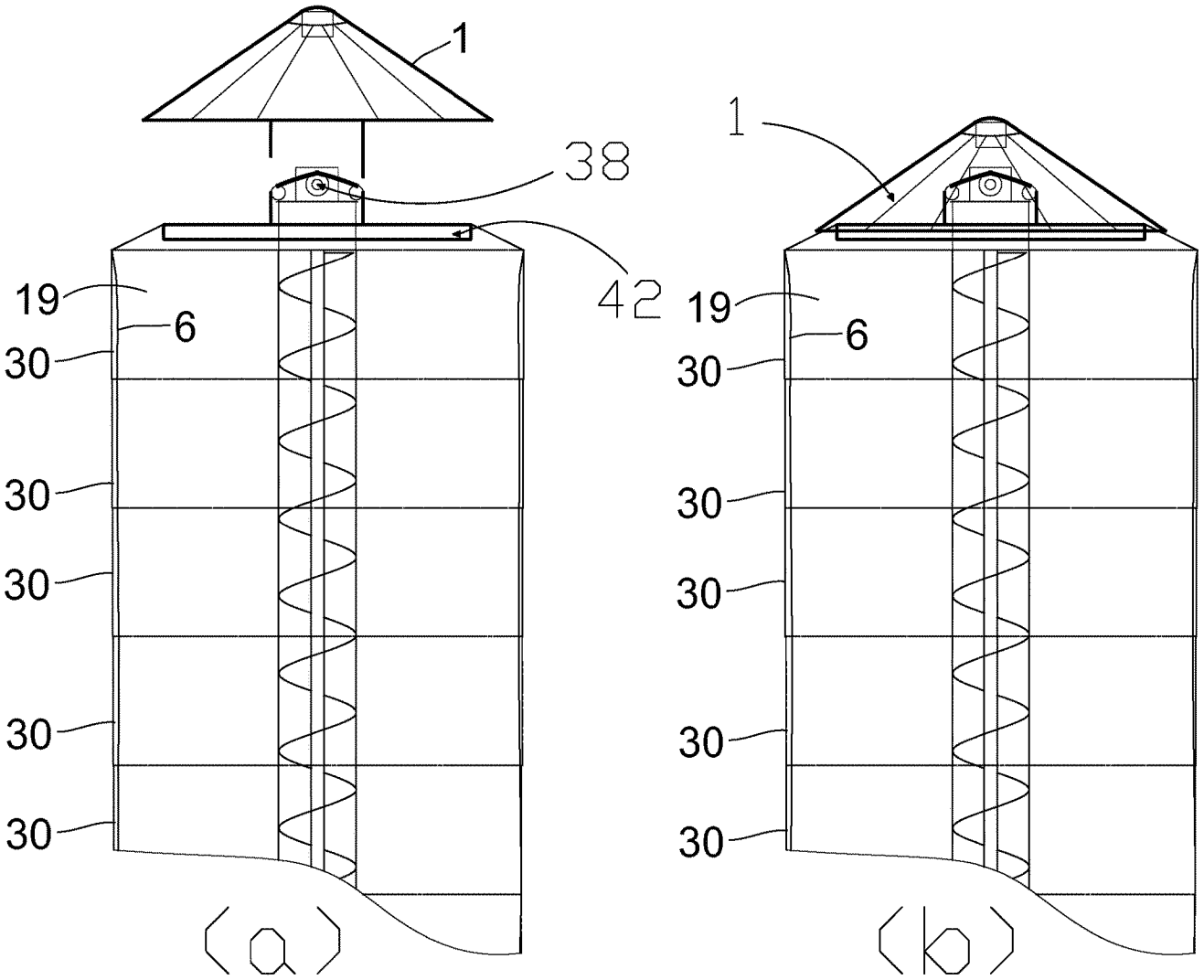
FIG. 14 further illustrates the mast lifting system shown in FIG. 13 in two views in which (a) is a longitudinal section of a silo structure showing the tubular members, the mast, the roof structure removed, and the exposed lifting winch system, and (b) is a longitudinal section of a silo structure showing the tubular members, the mast, the roof structure and the lifting winch system.
Figure 15:
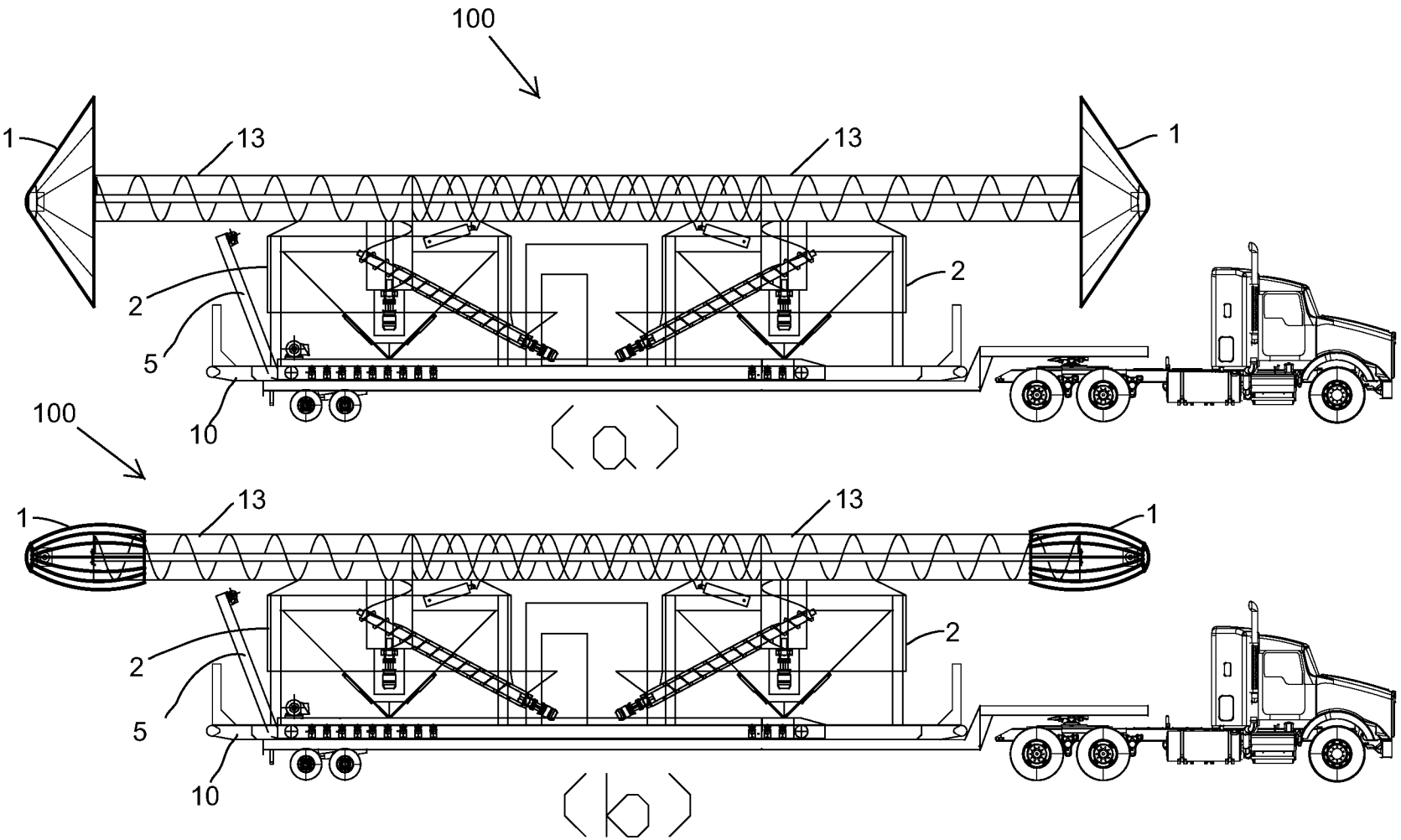
FIG. 15 illustrates the mobile collapsible storage silo of FIG. 1 in a collapsed configuration for transportation in two views in which (a) the roof system deployed and (b) the roof system is collapsed for transport.

Referring particularly to FIGS. 9*a*, 9*b* and 14*b*, a flexible inner liner 6 is provided within the shell assembly 2 for preventing particulate matter stored within the silo from soiling and interfering with the tubular members 30.

Within the space circumscribed by the outer shell assembly 2 is provided a central mast/loading system 13 that is capable of being raised and lowered at a rotation and locking mechanism 17 pivot. The mast/loading system 13 comprises an elongate tubular housing 32 within which is a screw or auger 25 that is journaled for rotation within the tubular housing 32. As the auger 25 rotates within the housing 32 it moves particulate material along the length of the housing and thereby provides a high-rate loading system by which particulate matter may be loaded into the silo as will be further described. In addition, the mast/loading system 13 also provides an elevating and supporting mechanism for the raising and lowering of the silo shell assembly 2.

Mobile collapsible storage silo 100 further comprises a sloped conical base assembly 12 connected to the frame 10 and having a chute system 18 capable of discharging into at least one conveying system 7 for the discharge of materials from the silos.

Mobile collapsible storage silo 100 further includes a collapsible roof structure 1 that covers the top of the silo shell 2 in the deployed configuration to prevent rain or other debris from falling into the silo structure. The collapsible roof 1 is generally similar in construction to that of an umbrella wherein a flexible roof membrane 34 supported on radially extending foldable rib members 36.

A lifting system is also included, which may comprise a cable winch 38 mounted at the upper end of the mast assembly 13 just below the roof system 1, and the auger drive system 14, such as lower motor 22 and upper motor 26, for rotating the auger 25. Extending from the cable winch 38 are cables 40 which extend downward and attached to the topmost tubular member 19 of the outer shell assembly 2. For example, the lift cables 40 may be attached to a lifting frame 42 that is connected to the topmost tubular member 19. Once the mast system 13 is lifted from the horizontal and secured into the vertical position via the rotation and locking mechanism 17, such that the lower motor 22 engages the lower end 23 of the auger 25, the cables 40, which extend from the lifting winch and connect to the outer shell sections, are spooled in to raise the entire shell assembly to the fully vertical position.

The shell sections or tubular members as shown in FIG. 9*b* are configured in such way as to allow each tubular member 30 to contact and engage with the tubular member 30 below via overlapping edges 20 and 21. As the topmost tubular member 19 is raised, the lower lip 20 of the topmost member engages with the upper lip 21 of the tubular member below and proceeds to raise and connect each shell member progressively until all shell members are extended upward to a limit provided by the innermost shell's lower lip coming into contact with the conical bottom edge 12.

A fabric or flexible membrane 6 forms a tubular and complete inner liner of each silo shell 2. This tubular liner remains on the inside of the shell sections and is effectively raised and lowered by the same methods as the outer shell. The flexible membrane is attached to the upper rim of the topmost/outer shell member 19 and, at the bottom, to the top of the conical hopper 12 which is attached to the frame assembly 10 via supporting members 3.

Once in the vertical and deployed configuration, the silo unit becomes a rigid structure caused by the resulting tension between the upper end of the mast and the frame assembly 10 provided by the lifting force exerted on the shell sections by the winch lines extending from the lifting system and transferred through the interconnecting shell member lips 20 and 21 and terminating at the top of the conical hopper section 12 and then through the supporting members 3 to the skid base 10.

In the illustrated embodiments, the frame assembly 10 is shown as a skid, but it may likewise be a trailer with wheels, or other movable structure. The frame 10 includes a plurality of retractable outriggers 5 that may be deployed to provide additional stability to the collapsible storage silo structure. The outriggers 5 may deployable by mechanical or hydraulic means as is known in the art. In the illustrated embodiments, the frame 10 supports two silo structures 2 but it will be apparent to persons skilled in the art that other embodiments may have one silo structure, or more than two silo structures.

In the illustrated embodiment, there is also provided a control unit 16 on frame assembly 10 that houses various electric and/or hydraulic controls for the mobile collapsible storage silo 100, such as for example controls for one or more of the mast lifting system, the roof deployment system, the silo shell raising system, the outrigger deployment system, the auger drive system, the material feed systems, and any other electric or hydraulic system provided on the mobile collapsible storage silo. In some embodiments, the controls may be provided in a simple control panel, or they may be dispersed individually at various locations on the mobile storage silo.

Figure 3:
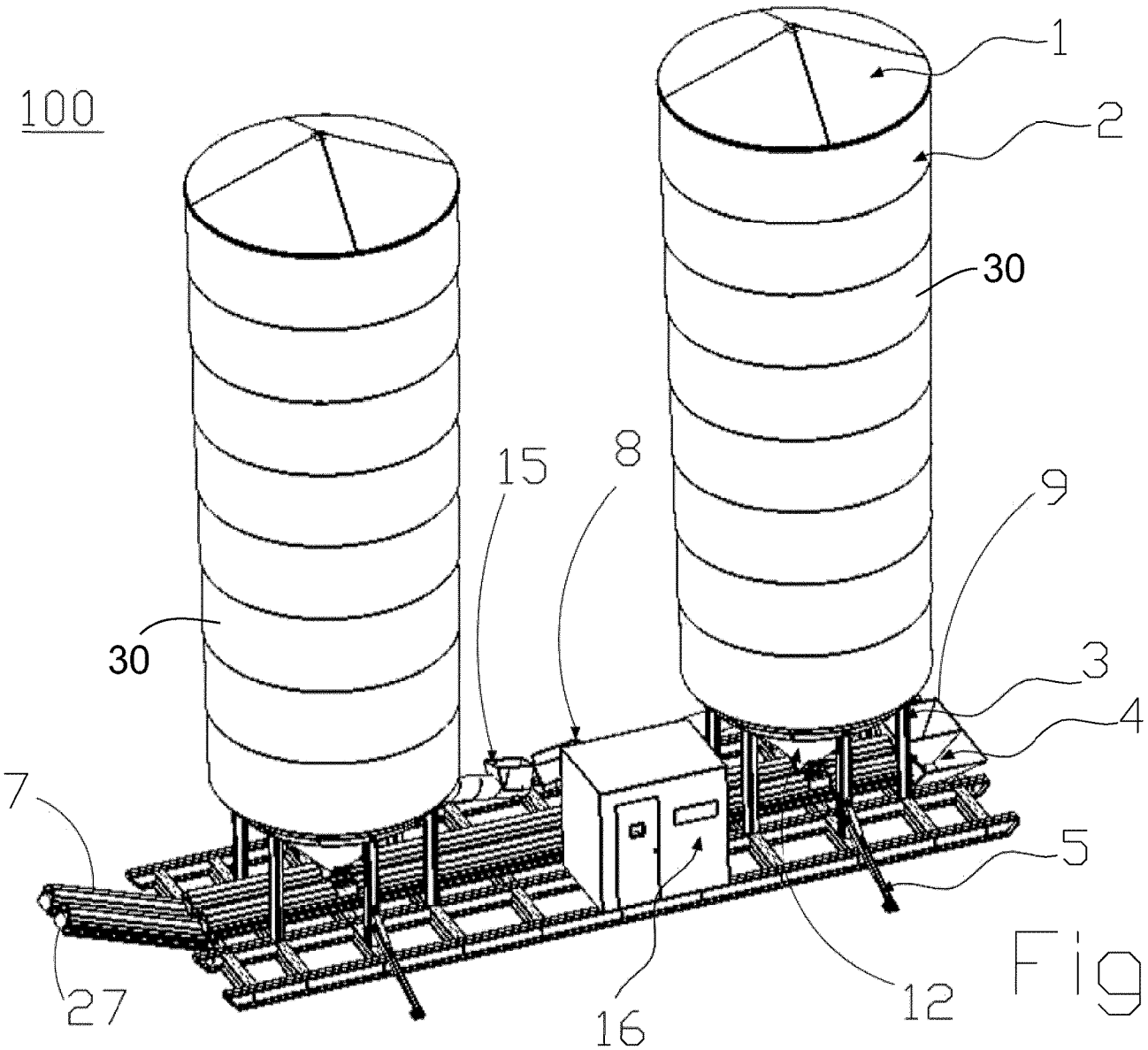
FIG. 3 is a perspective view of the mobile collapsible storage silo of FIG. 1 shown in a deployed operational configuration.
Figure 4:
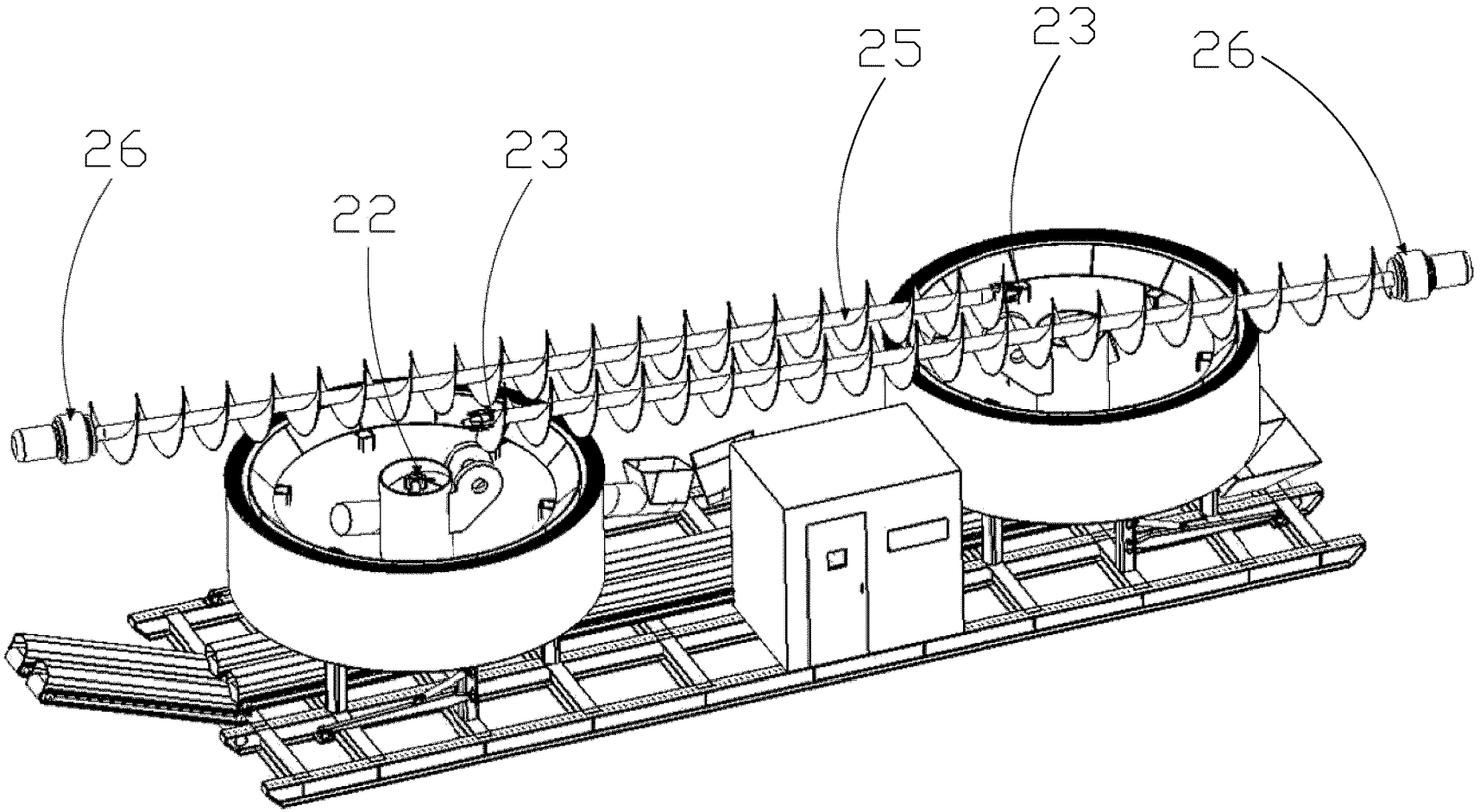
FIG. 4 is a perspective view of the mobile collapsible storage silo of FIG. 1 showing exposed vertical screw systems.
Figure 5:
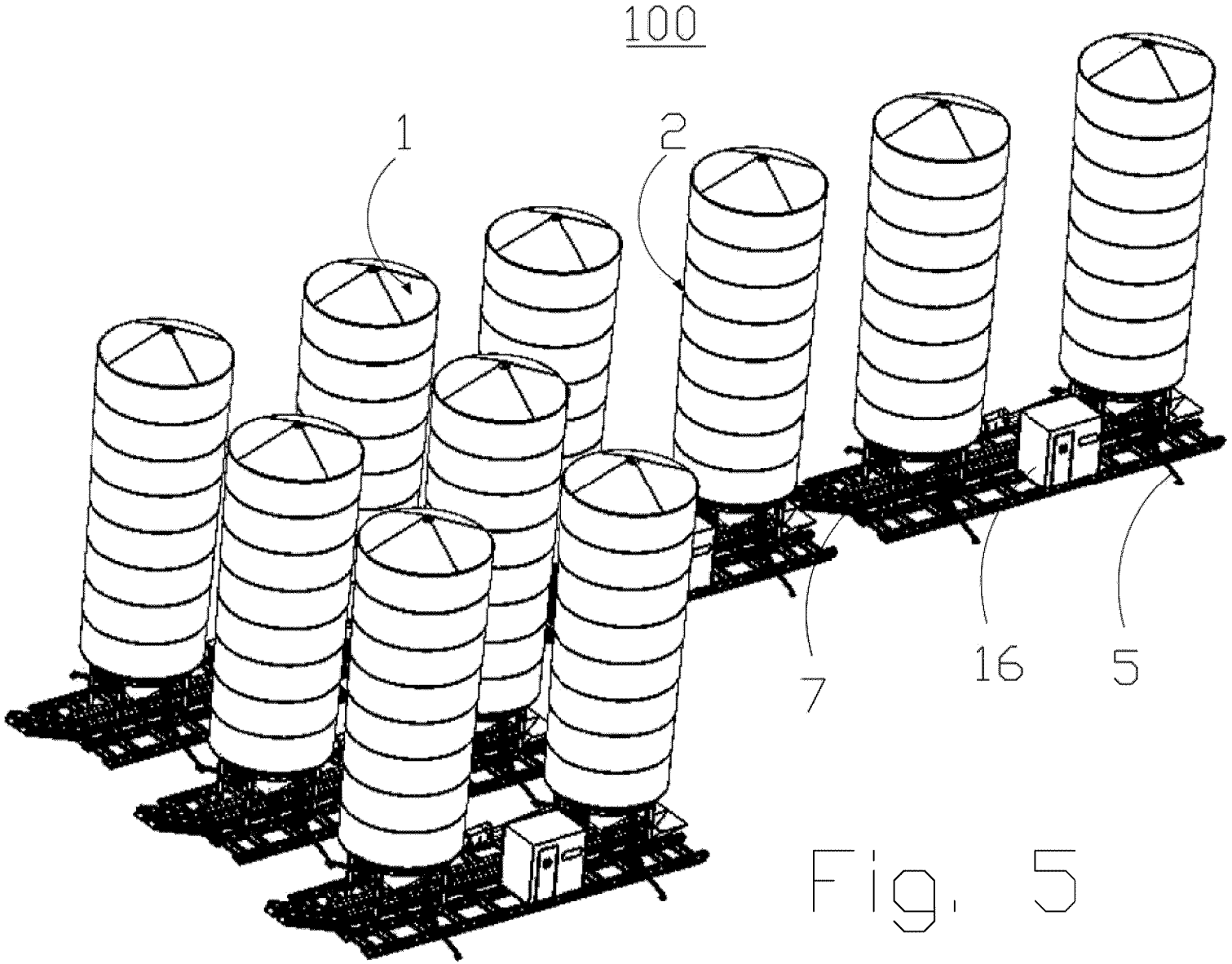
FIG. 5 is a perspective view showing multiple mobile collapsible storage silos of FIG. 1, each in an operational configuration.
Figure 6:
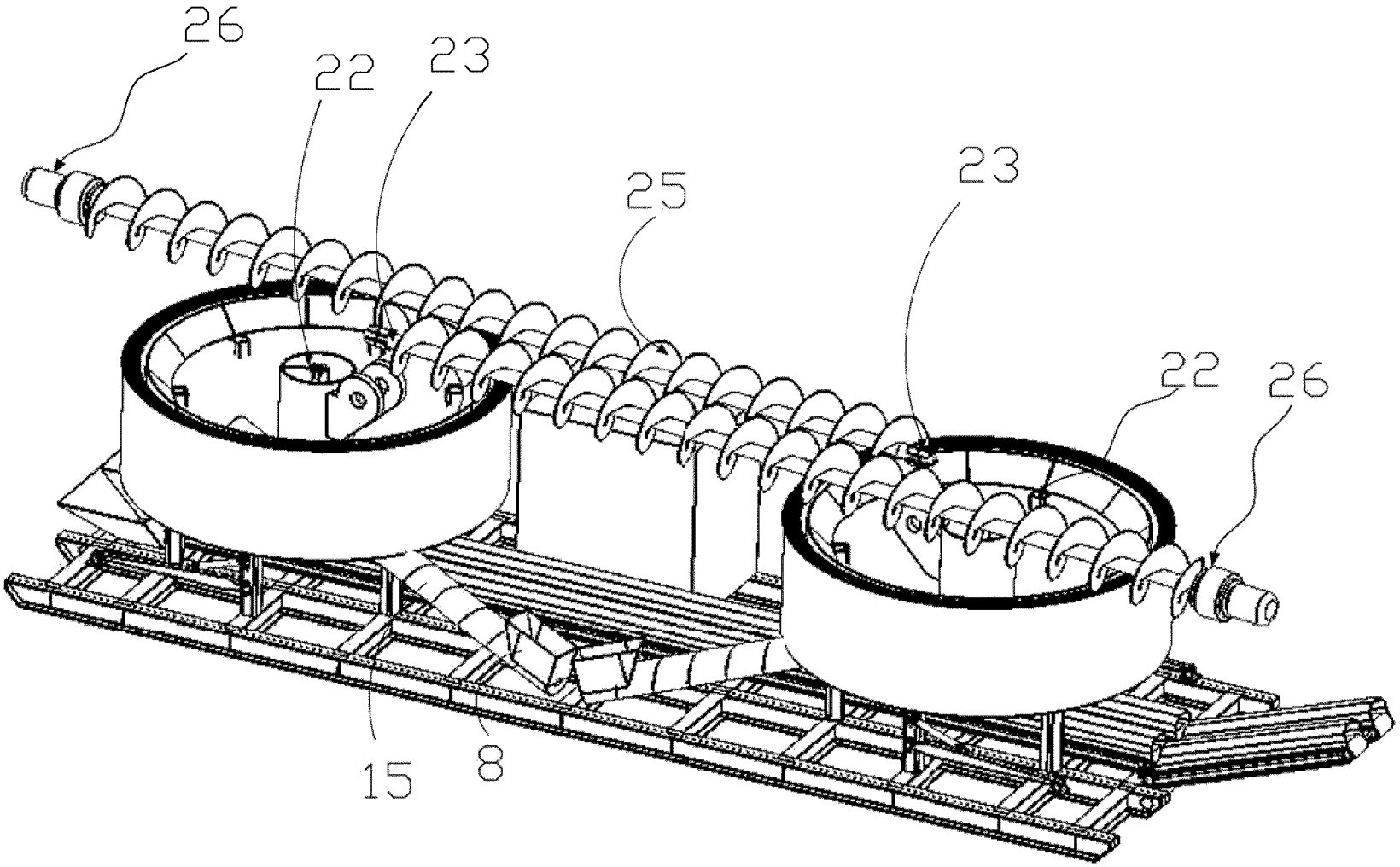
FIG. 6 is a perspective view of the mobile collapsible storage silo of FIG. 1 showing the lower material feeding mechanism and chutes for fitting to the input connection of the vertical screw mechanisms.
Figure 7:
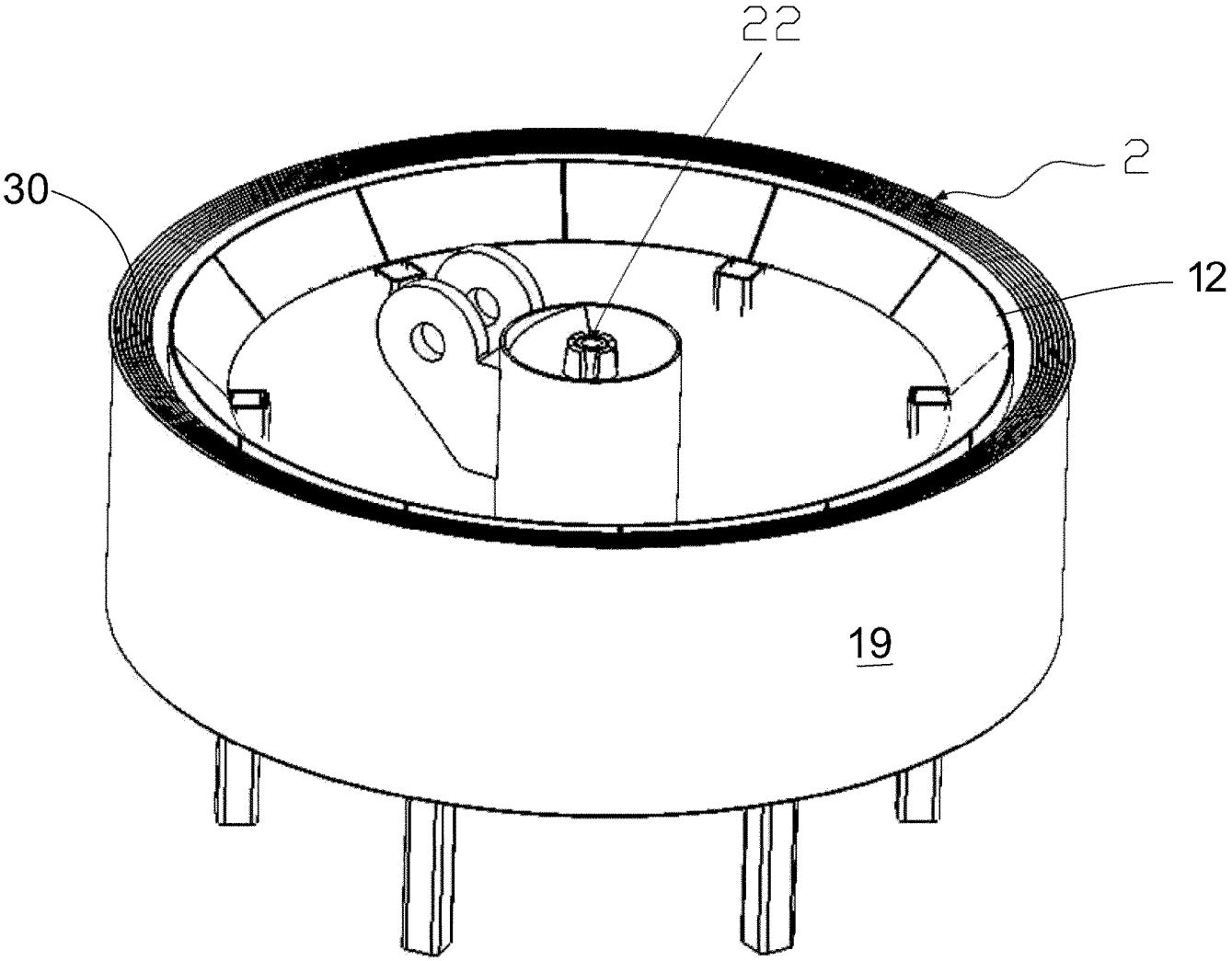
FIG. 7 is a close-up perspective view of the coaxially nested outer shell sections of the mobile collapsible storage silo FIG. 1 that are attached to the conical bottom section and shown in a collapsed configuration.
Figure 8:
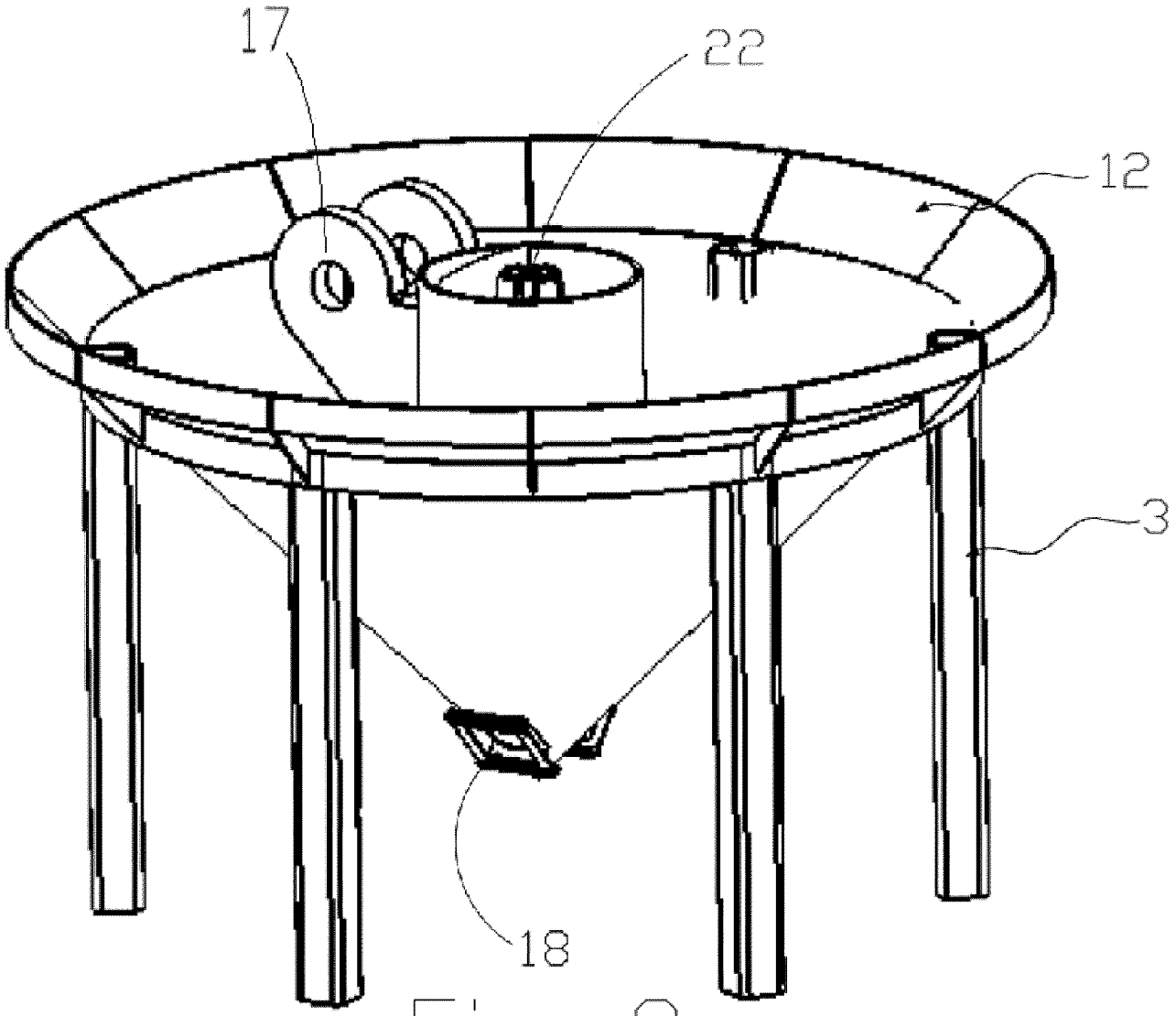
FIG. 8 is a close-up perspective view of the base showing the hopper bottom chute mechanism of the mobile collapsible storage silo of FIG. 1.

The deployment steps of the collapsible storage silo 100 from the collapsed transport configuration are as follows. The outriggers 5 are deployed to provide additional lateral stability to the assembly. The collapsible roof 1 is deployed by extending the foldable rib members 36 to extend the overlying roof membrane 34, and the structure is locked into place. The mast 13 is raised from the horizontal position into the vertical position and locked into place via the rotation and locking mechanism 17. Winch 38 attached to lift cables 40 that attach to the upper ring of topmost/outer shell section 19 are retracted until all shell members are listed resulting in a fully deployed silo shell to as shown in FIG. 3. Particulate material, such as for example fracking proppant, sand, grain, and the like, may then the delivered to inlet hopper 8 of the lower feed conveyors 15, which conveys the material to the inlet of the vertical screw conveyor/mast 13. The vertical screw conveyor receives the material from the outlet of feed conveyor(s) 15 and the screw assembly or auger 25, being driven by drive motors 26 and 22 located at the top and bottom, respectively, of the mast assembly 13 rotate in such a way to elevate the material vertically to the top of the mast assembly 13 where it is discharged from the housing via ports 24. The particulate material then falls to the bottom of the silo envelope/liner 6 and as the cavity is filled and the level moves upward. The materials are contained by the fabric tubular liner 6 and supported by the metal shell sections 2 with the weight being supported by the conical hopper to the supporting members to the frame assembly 10.

Discharge of the material takes place first by the opening of discharge gates 18 allowing material to flow into discharge conveyor(s) 7. When the collapsible storage silos 100 are deployed in multiples, the discharge conveyors 7 may be configured in such a way to be able to discharge at outlet 27 and into inlet 4 of the next unit when deployed in a lineal configuration.

The collapsible storage silo 100 may be configured into the collapsed transport configuration by first emptying the silo structures 2 of all materials. The tension on the winch cables is released thereby lowering the shell sections 30 as per FIG. 1. The masts are then rotated to the horizontal and the roof structure is retracted as per FIG. 1. The collapsible storage silo unit is thus ready for transport.

While specific embodiments of the invention have been described, such embodiments are illustrative of the invention only and should not be taken as limiting its scope. In light of the present disclosure, many modifications will occur to those skilled in the art to which the invention relates, and the invention, therefore, should be construed in accordance with the accompanying claims.

What is claimed is:

1. A collapsible storage silo having an expanded configuration, the silo comprising:

a frame;

a mast attached to the frame and being pivotable between horizontal and vertical positions relative to the frame;

a shell for circumscribing storage space of the silo, the shell comprising a plurality of concentrically nested tubular members that are collapsible; and a lift system comprising a lift element operatively connected between the mast and the shell so as to be operable to slidably expand the plurality of concentrically nested tubular members to place the silo in the expanded configuration;

the mast being operable to support the lift system.

2. The silo of claim 1 wherein the frame includes a plurality of retractable outriggers.

3. The silo of claim 1 wherein the mast is centrally disposed within the plurality of concentrically nested tubular members when the silo is in its expanded configuration.

4. The silo of claim 1 wherein each said concentrically nested tubular member comprises at least one of a lower lip and an upper lip, wherein a lower lip of one of said concentrically nested tubular members and an upper lip of an adjacent one of said concentrically nested tubular members engage each other when the silo is in the expanded configuration.

5. The silo of claim 4 wherein the lower lip is inwardly projecting and the upper lip is outwardly projecting.

6. The silo of claim 1 wherein the lift system comprises a winch attached to the mast and the lift element comprises a lift cable extending between the winch and the plurality of concentrically nested tubular members.

7. The silo of claim 6 wherein the plurality of concentrically nested tubular members comprise an outermost tubular member among the concentrically nested tubular members, and wherein the lift cable extends between the winch and said outermost tubular member.

8. The silo of claim 1 wherein each said concentrically nested tubular member comprises at least one of an inwardly projecting lower lip and an outwardly projecting upper lip, wherein an inwardly projecting lower lip of one of said concentrically nested tubular members and an outwardly projecting upper lip of an adjacent one of said concentrically nested tubular members engage each other when the silo is in the expanded configuration, the plurality of concentrically nested tubular members comprise an outermost tubular member among the concentrically nested tubular members, and wherein the lift system comprises a winch attached to the mast and the lift element comprises a lift cable extending between the winch and said outermost tubular member.

9. The silo of claim 1 wherein the plurality of concentrically nested tubular members comprise an outermost tubular member among the concentrically nested tubular members, the silo further comprising a flexible inner liner attached to said outermost tubular member.

10. The silo of claim 9 wherein the plurality of concentrically nested tubular members comprise an innermost tubular member among the concentrically nested tubular members, the silo further comprising a conical hopper dimensioned for engaging said innermost tubular member when the silo is in the expanded configuration, the flexible inner liner being attached between said outermost tubular member and the conical hopper.

11. The silo of claim 1 comprising a collapsible roof attached to the mast.

12. The silo of claim 11 wherein the collapsible roof comprises a flexible roof membrane and a plurality of radially extending foldable rib members for supporting the flexible roof membrane.

13. The silo of claim 1 wherein the mast is a tubular mast and comprises an auger disposed within the tubular mast, the auger being operable to move granular material along and within the tubular mast.

14. The silo of claim 1 further comprising a control unit comprising a control selected from the group consisting of an electrical control and a hydraulic control.

15. A method of deploying a collapsible storage silo from a collapsed configuration to an expanded configuration, the method comprising:

(a) deploying a collapsible roof of the silo;

(b) pivoting a mast of the silo to a vertical position relative to a frame of the silo; and (c) when the mast is in the vertical position, operating a lift system comprising a lift element operatively connected between the mast and a plurality of concentrically nested tubular members of the silo so as to slidably expand the plurality of concentrically nested tubular members of the silo, thereby placing the silo in the expanded configuration.

16. The method of claim 15 wherein the lift system comprises a winch attached to the mast and the lift element comprises a lift cable extending between the winch and the plurality of concentrically nested tubular members, the method further comprising operating the lift system by operating the winch until lower and upper lips of adjacent tubular members among the concentrically nested tubular members engage each other and an innermost tubular member among the concentrically nested tubular members at its lower lip engages a hopper attached to the frame.

17. The method of claim 15 comprising deploying the collapsible roof of the silo by:

(a) extending foldable rib members of the roof to extend an overlying roof membrane; and (b) locking the roof in a deployed configuration of the collapsible roof of the silo.

18. The method of claim 15 further comprising deploying a plurality of outriggers attached to the frame prior to pivoting the mast.

* * * * *